United States Patent [19]

Smith et al.

[11] 4,116,394

[45] Sep. 26, 1978

[54] MOVING FILAMENT GRIPPING MECHANISM

[75] Inventors: Robert E. Smith, Monte Sereno; Frank S. Chytil, Escondido, both of Calif.; George Feldstein; Dorman J. Swartz, both of Madison, N.J.

[73] Assignee: Allied Chemical Corporation, Morris Township, Morris County, N.J.

[21] Appl. No.: 815,732

[22] Filed: Jul. 14, 1977

Related U.S. Application Data

[63] Continuation-in-part of Ser. No. 703,715, Jul. 9, 1976, abandoned.

[51] Int. Cl.[2] ..... B65H 54/00; B65H 65/00; B65H 75/28

[52] U.S. Cl. ..... 242/25 R; 242/47; 242/48; 242/125.1

[58] Field of Search ..... 242/25 R, 25 A, 47, 242/48, 18 A, 18 PW, 18 R, 19, 74, 78, 54 R, 67.1, 125.1, 80, 81

[56] References Cited

U.S. PATENT DOCUMENTS

| | | | |
|---|---|---|---|
| 2,661,161 | 12/1953 | Hick et al. | 242/25 R |
| 3,152,768 | 10/1964 | Astrom | 242/25 A |
| 3,695,528 | 10/1972 | Taki et al. | 242/25A |

FOREIGN PATENT DOCUMENTS

| | | | |
|---|---|---|---|
| 1,367,513 | 9/1974 | United Kingdom | 242/25 A |

*Primary Examiner*—Stanley N. Gilreath
*Attorney, Agent, or Firm*—Gerhard H. Fuchs

[57] ABSTRACT

An apparatus designed to catch a rapidly advancing metal filament and, while the filament is continuously advancing, to secure the filament and, optionally, to cut and secure the end of the filament to a winding reel rotating at high speed. The reel is secured to and rotated by a reel mounting assembly. The apparatus includes triggering means which, when actuated, moves a grip lever mounted on the reel mounting assembly to lock the advancing filament to the core of the reel.

6 Claims, 11 Drawing Figures

MOVING FILAMENT GRIPPING MECHANISM

CROSS-REFERENCE TO RELATED APPLICATION

This application is a continuation-in-part of our copending application Ser. No. 703,715 filed July 9, 1976, now abandoned.

BACKGROUND OF THE INVENTION

Various methods are known in the art for securing ends of filamentary material to rotating storage reels and spools. However, none of the known methods have been found adequate to suitably cut and grip rapidly moving metal filaments, which may move at rates in excess of a mile a minute, i.e., at speeds in the order of 1,000 to 6,000 ft./min. and greater. Speeds of this magnitude are frequently a prerequisite to a practical operation if the desired characteristics of the filament are to retained. For example, the amorphous character of metal alloys such as those described in U.S. Pat. No. 3,856,513, results from exceedingly high quench rates, i.e., in the order of many hundreds of degrees per second. As a consequence, such amorphous filament must be spun, quenched and ejected at extremely high rates. It is thus apparent that a need exists for apparatus which is suitable to grasp and store filaments which are being processed at a rate of many hundreds of feet per minute, or more, while the filament is in movement.

SUMMARY OF THE INVENTION

The present invention provides an apparatus for gripping and retaining an advancing filament on a rotating storage reel comprising, in combination, (a) a reel having a core; (b) a rotatable reel mounting assembly for receiving said reel; (c) a pivotable filament gripping element associated with said reel mounting assembly having a gripping leg adapted to hold the filament, when the gripping element is in the closed position, against the core of said reel in gripping engagement, and adapted further to be locked in an open position with the gripping leg away from said reel core; (d) biasing means adapted to pivot said filament gripping element into closed position to bring the gripping leg into gripping engagement with the filament and the core of said reel; (e) retaining means adapted to releasably hold said gripping element in open position; and (f) triggering means adapted to release said retaining means to permit said biasing means to pivot said filament gripping element to closed position to bring the gripping leg into gripping engagement with the filament and the core of said reel.

The reel provides a means for storing the filament. The filament is wound on the core of the reel. The reel in turn is mounted on the rotatable reel mounting assembly which imparts rotating movement to the reel for winding the filament. A pivotable filament gripping element is provided in association with the reel mounting assembly. The pivotable filament gripping element serves to grip the advancing filament and to hold it against the core of the reel in gripping engagement. To that end, the pivotable filament gripping element is provided with a gripping leg. The pivotable filament gripping element can be held in two distinct positions, namely, an open position and a closed position. In open position, the gripping leg of the pivotable filament gripping element is positioned away from the core of the reel. Retaining means are provided adapted to releasably hold the gripping element in the open position. In closed position, the gripping leg holds the filament against the core of the reel in gripping engagement. Biasing means are provided adapted to pivot the filament gripping element into closed position to bring the gripping leg into gripping engagement with the filament and the core of the reel.

There is further provided triggering means adapted to release the retaining means to permit the biasing means to pivot the filament gripping element into closed position to bring the gripping leg into gripping engagement with the filament and the core of the reel. The gripping leg may optionally be provided with a cutting edge so that, as the gripping leg grips the filament which is moving over the core of the reel, the leg, by its single movement cuts off the advanced end of the filament and secures the filament to the core of the rotating reel. The severed end of the filament is spun away, so that interference from the severed end with the winding operation is avoided. After the filament is gripped and optionally cut, the winding progresses in usual manner until the reel is filled to desired extent. Thereafter, a replacement reel replaces the filled reel in conventional manner.

DETAILED DESCRIPTION OF THE INVENTION, OF THE PREFERRED EMBODIMENTS AND OF THE BEST MODE PRESENTLY CONTEMPLATED FOR ITS PRACTICE

The present invention is further illustrated with reference to the drawings. The essential features of the invention which reside in means for grasping and securing an advancing filament, such as metal strip, against the core of the rotating storage reel, as an integral part of a process for making metal strip from molten metal, will be described in connection with FIG. 1. It should be apparent, however, that the invention is not limited to advance in the process of the kind described in conjunction with FIG. 1, but may be used for gripping and retaining any kind of advancing filament against the core of the rotating storage reel, such as textile fibers, plastic strips, etc.

Figure 1:
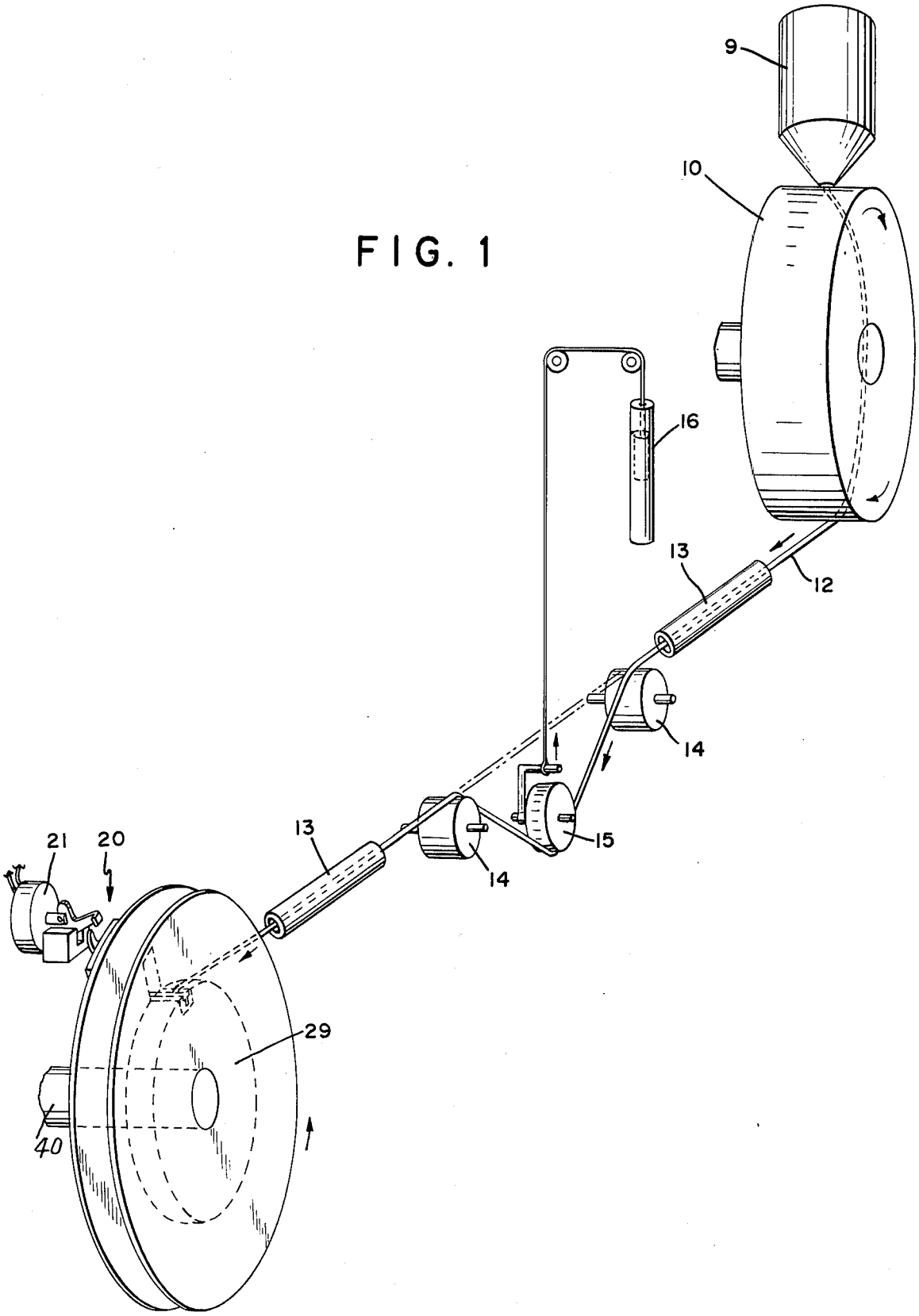
FIG. 1 is a perpective schematic view of apparatus for producing a metal filament by quenching from the melt incorporating the filament gripping and retaining apparatus of the present invention.

As illustrated in FIG. 1, molten metal from reservoir 9 is extruded or otherwise deposited in a fine stream against the peripheral surface of a rapidly rotating quench roll 10, which is suitably mounted on a support. The stream of molten metal so deposited solidifies and forms a metal strip 12. The strip 12 thereafter is to be wound on the core of storage reel 29. To that end, strip 12 may be passed through guide means 13 and optionally, a tension control arrangement. The tension control arrangement may comprise any appropriate system, and as shown, includes stationary rotating guide rollers 14 and a vertically movable "dancing" roller 15, which is appropriately coordinated through a servo mechanism with a counter-balancing means 16. Dancing roller 15 is responsive to the amount of slack in strip 12 and is self-adjusting, such that an essentially uniform tension is maintained in strip 12. Dancing roller 15 and counter-balancing means 16, which is responsive to the amount of slack in strip 12 to maintain essentially uniform tension in strip 12, may comprise any suitable device capable of performing this function, such as that disclosed in U.S. Pat. No. 3,831,412. The strip 12 thereafter is fed to a winding arrangement 20 including reel mounting assembly 40 which incorporates the apparatus for gripping and retaining the advancing strip whereby the rapidly advancing strip 12 is grasped and secured on storage reel 29.

Figure 2:
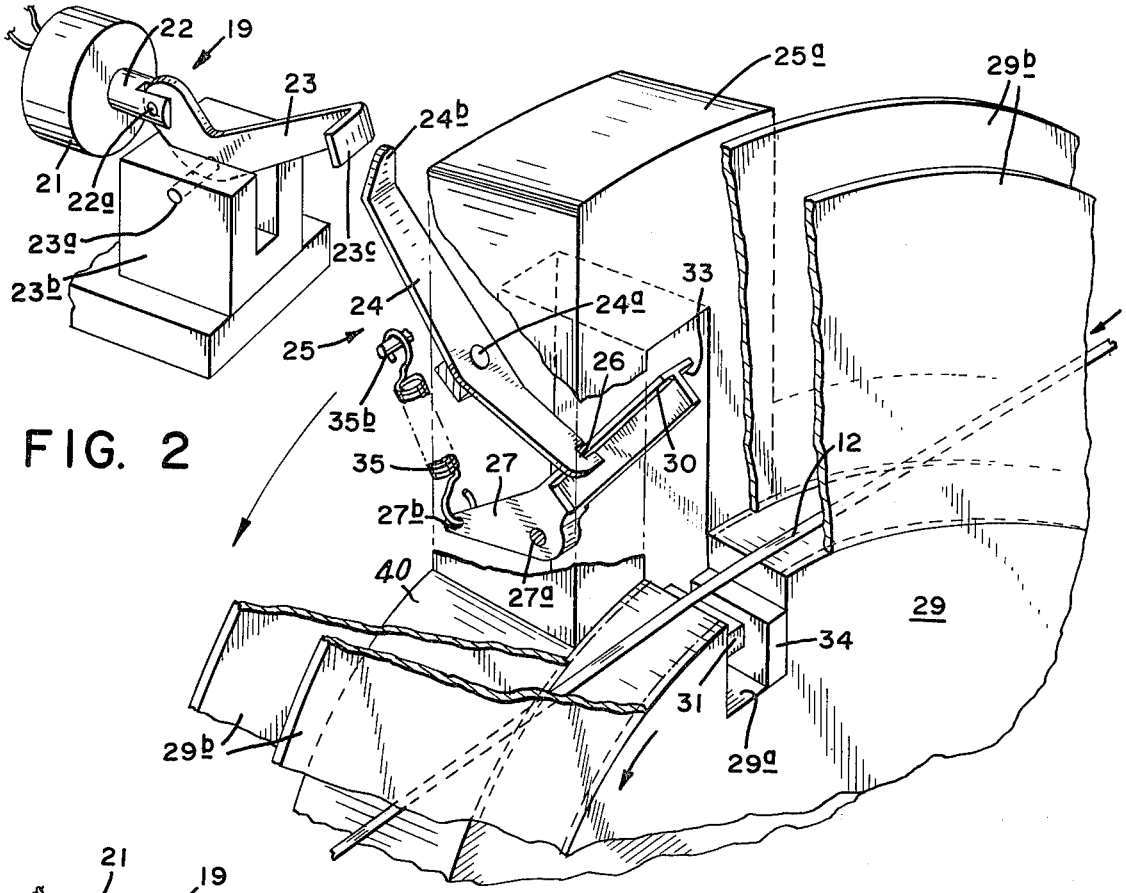
FIG. 2 is a fragmentary schematic view of the gripping and retaining apparatus in the open position illustrating a gripping leg provided with an optional cutting edge.
Figure 3:
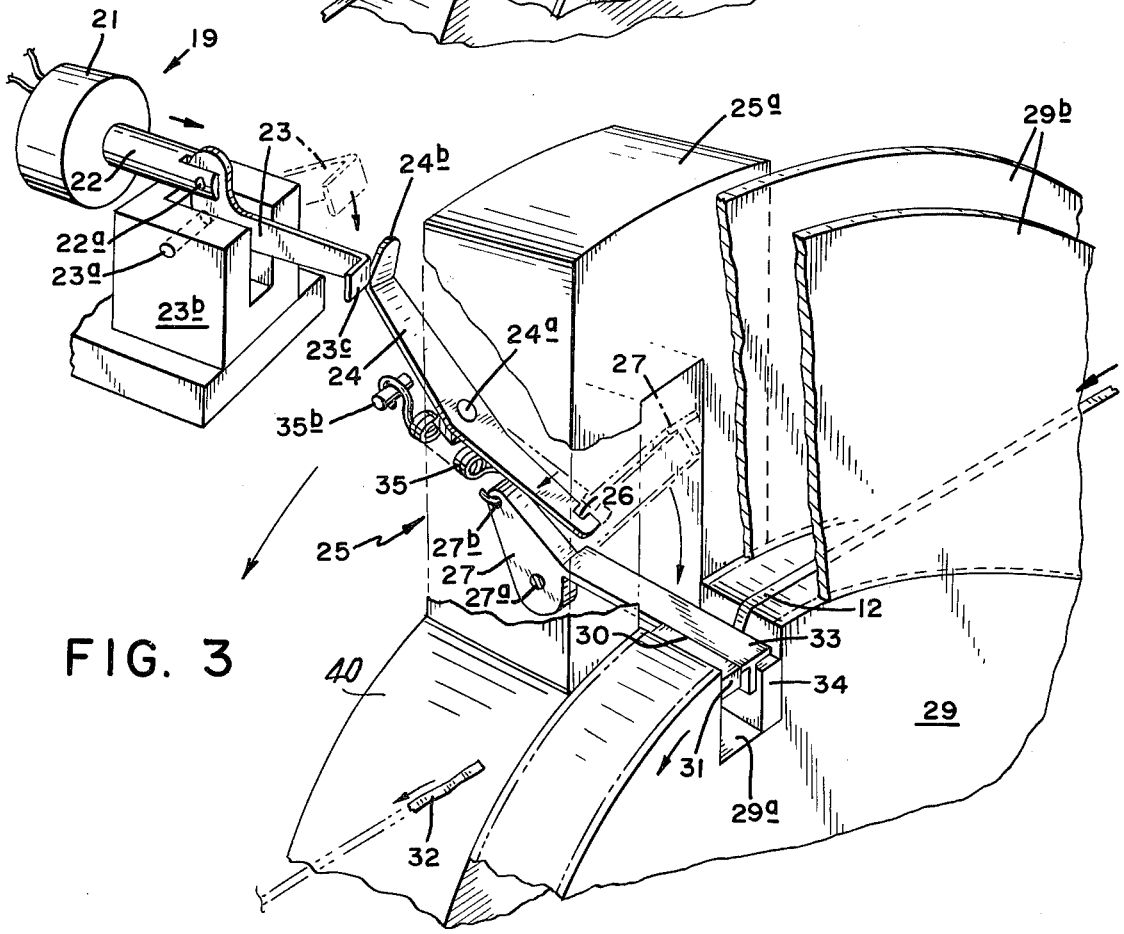
FIG. 3 is a fragmentary view of the gripping and retaining apparatus shown in FIG. 2, but wherein the gripping element is in closed position such that the gripping leg holds the filament against the core of the reel in gripping engagement.

The invention is described in further detail with reference to FIGS. 2 through 11 which illustrate the apparatus of the present invention and its function. Referring to FIGS. 2 and 3, strip 12 is passed over the core of storage reel 29 which may be provided with optional recess 29*a*. Storage reel 29 is attached to reel mounting assembly 40 for rotation. There is also provided an actuating assembly 25. Mounted in optional recess 29*a* there may be provided a gripper pad 34 which may be formed of resilient material and, optionally, a stationary cutting blade 31 which in conjunction with gripping lever 27 cooperate to simultaneously cut, as well as grip, the advancing filament. The actuating assembly 25 comprises a support 25*a*, a gripping lever 27 and a retaining element 24. Retaining element 24 is pivotably mounted at 24*a* on support 25*a* and, as shown at 26, serves at one end to hold lever 27 in locking engagement in cocked position (shown in FIG. 2) against the force of spring 35. Gripping lever 27 is formed with a gripping edge 33 and, optionally, cutting edge 30 at the opposite side thereof. Spring 35 is secured at one end on support 25*a* by means of retaining member 35*b* and is secured at the other end to end 27*b* of the dog leg-like portion of gripping lever 27, which is pivotably mounted at 27*a*.

A suitable triggering means is shown at 19 which may comprise any suitable device for remotely actuating the cutting and gripping mechanism. With reference to FIGS. 2 and 3, triggering means 19 comprises a solenoid 21, a solenoid shaft 22 and a connecting element 23 which is pivotably attached at 23*a* to support 23*b* and at 22*a* to solenoid shaft 22. Suitable means, such as a photoelectric detector (not shown), may be employed to sense the presence of strip 12 passing over the core of reel 29 to thereby trigger triggering means 19.

In operation, the device of the present invention functions as follows. At a suitable time when it is desired to wind the strip which is passing over the rotational core of reel 29, triggering means 19 is actuated by passing an electrical current through solenoid 21, thereby extending solenoid shaft 22, which in turn pivots lever 23 downwardly so that the end 23*c* of lever 23 contacts the extremity 24*b* of retaining element 24. Retaining element 24 is pivoted at 24*a*, and at its opposite end locks gripping lever 27 in groove 26 formed in retaining element 24; this holds gripping lever 27 against the force of the extended spring 35. When the retaining element 24 is disengaged at 26 through the action of lever 23 on the end 24*b* of retaining element 24, gripping lever 27 is pivoted so that its free end enters opening 29*a* formed in the core of reel 29. This movement has the effect of gripping strip 12 between the gripping edge 33 of gripping lever 27 and gripper pad 34. This action also engages strip 12 between the cutting edge 30 of gripping lever 27 and the stationary cutting blade 31, thereby simultaneously cutting and gripping strip 12 against the core of reel 29. Severed end 32 of strip 12 is cast aside. Triggering means 19 is suitably actuated with the speed of the advancing strip and the peripheral velocity of the rotating core are approximately matched. Winding progresses until the desired amount of strip is stored on the core of reel 29 between reel faces 29*b*. When the reel has accumulated the desired quantity of strip, the winding operation is discontinued, the strip is cut, the end of the cut strip may be secured to the reel, and the reel 31 is removed in any suitable manner.

Figure 4:
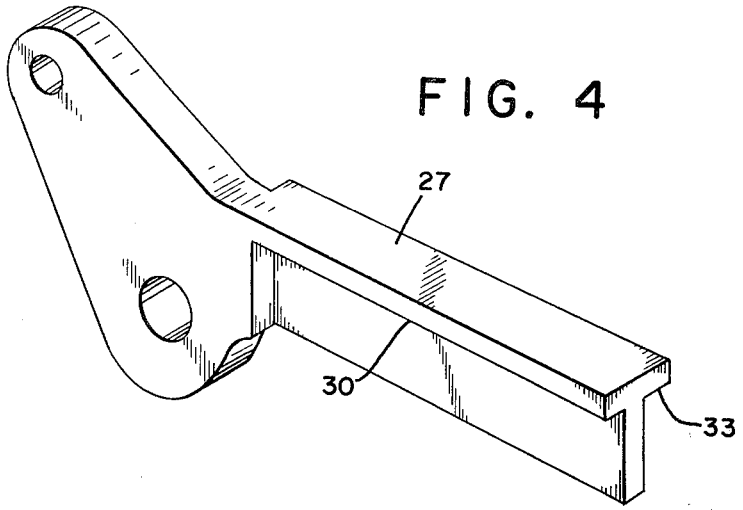
FIG. 4 is an enlarged view of a pivotable filament gripping element having an optional cutting edge.
Figure 5:
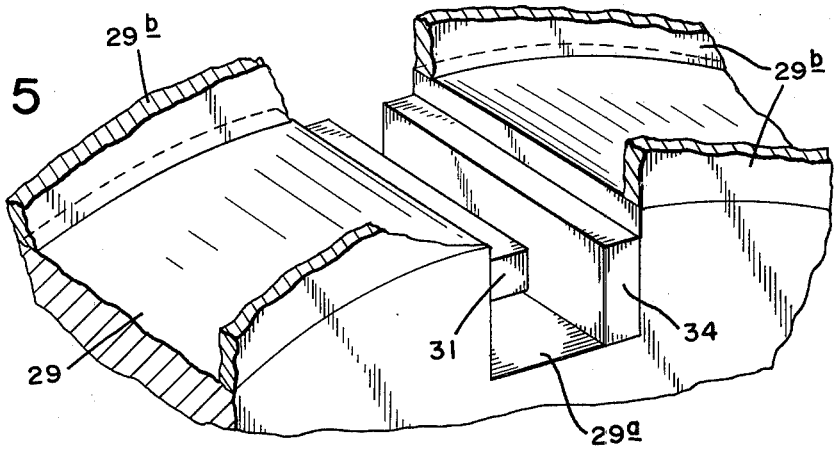
FIG. 5 is a fragmentary view of the reel core having an optional recess provided therein for engagement with the gripping leg of the pivotable filament gripping element as illustrated in FIG. 4.
Figure 6:
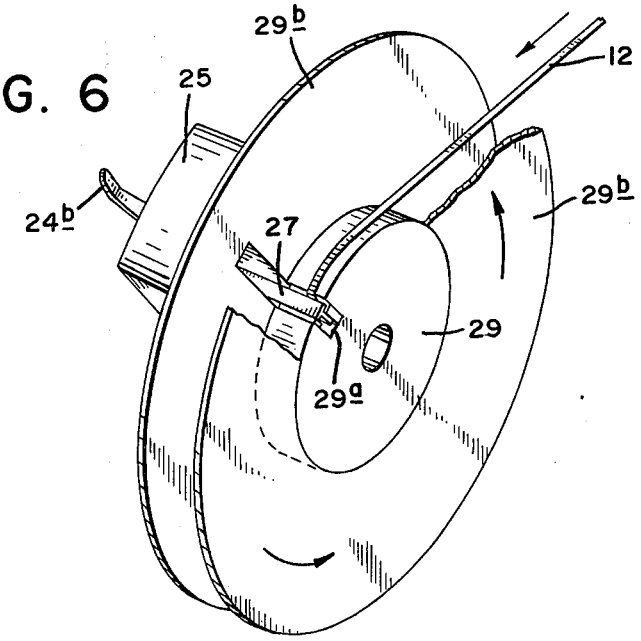
FIG. 6 is another fragmentary view having one of the storage reel face plates partially cut away illustrating a pivotable filament gripping element of the type illustrated by FIG. 4 in closed position against a reel core having the configuration shown in FIG. 5.

FIGS. 4, 5 and 6 provide more detailed views of the above-described embodiment of the gripping lever 27, recess 29*a* of the core of storage reel 29 with associated optional stationary cutting blade and gripping edge.

Figure 7:
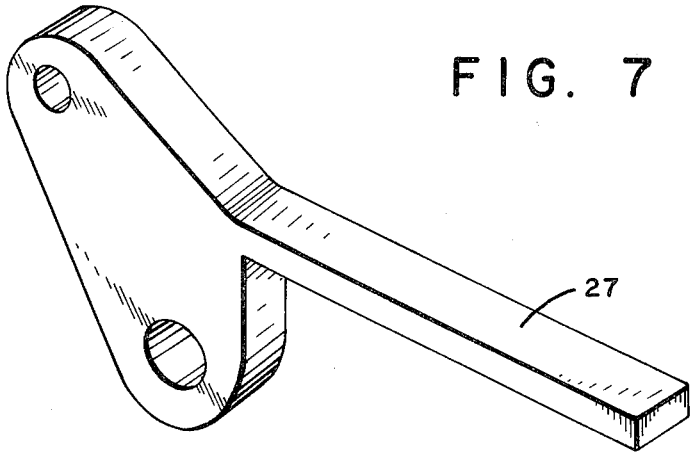
FIG. 7 is an enlarged view of another embodiment of a pivotable filament gripping element of the present invention.
Figure 8:
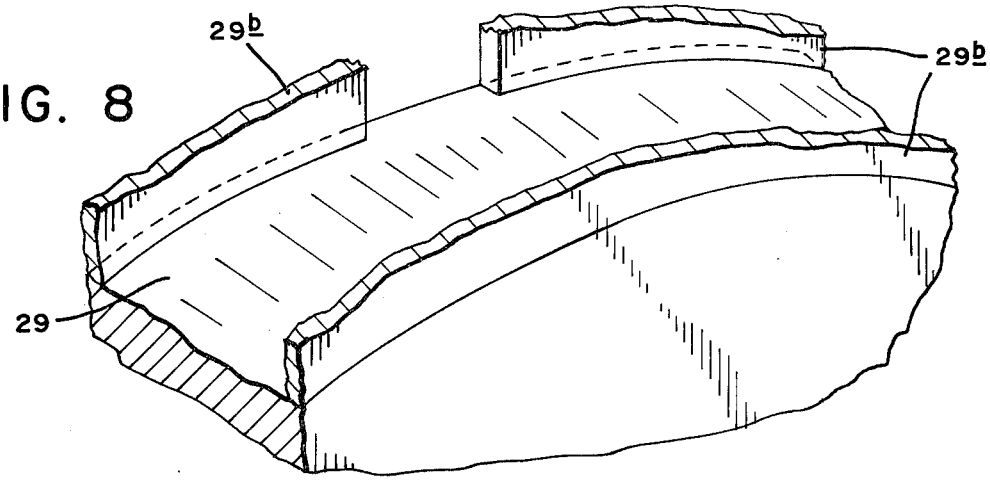
FIG. 8 is a fragmentary view of a plain reel core not provided with a recess for use in conjunction with a pivotable filament gripping element of the type illustrated by FIG. 7.
Figure 9:
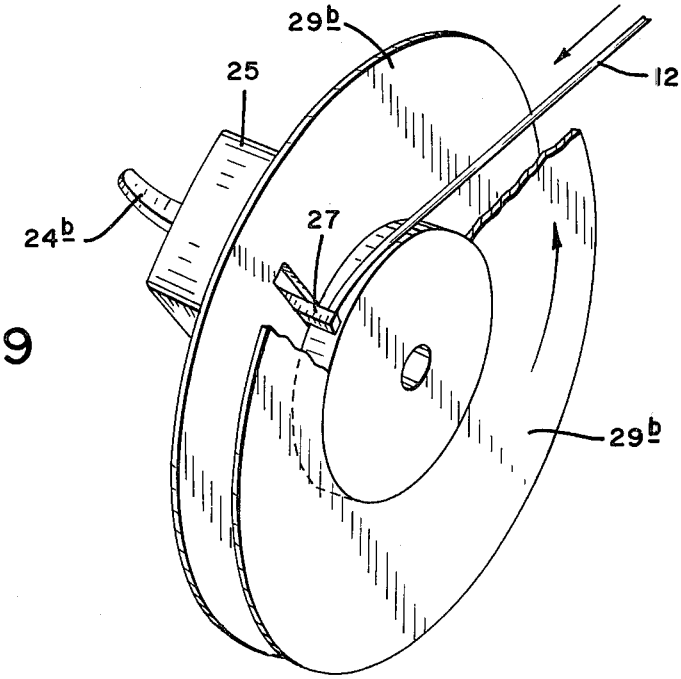
FIG. 9 is a fragmentary view showing one of the storage reel face plates partially cut away with the filament gripped against the reel core by a pivotable filament gripping element of the type illustrated by FIG. 7.
Figure 10:
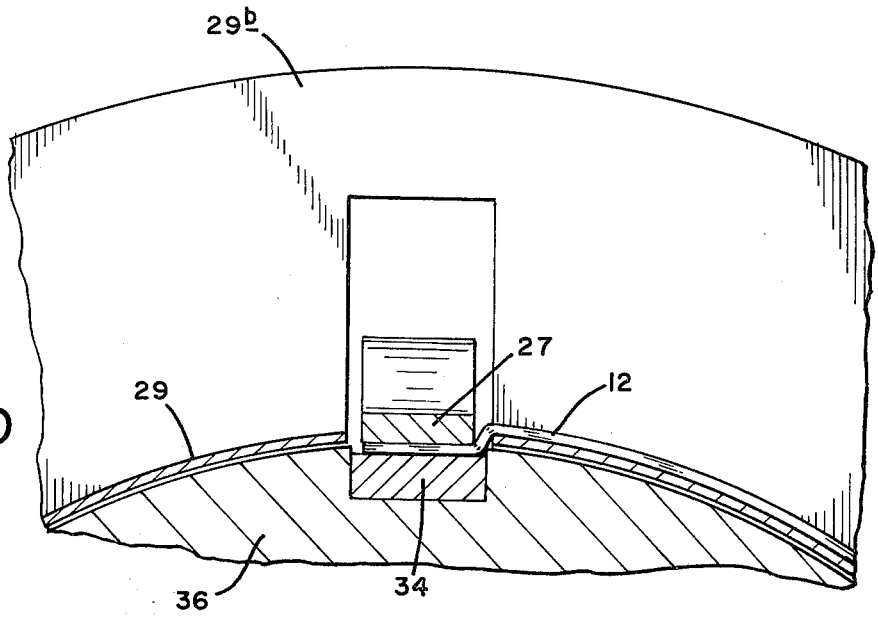
FIG. 10 is a cross-sectional view of a reel core provided with a recess having a gripper pad disposed therein, showing the gripping lever in closed position holding the strip in gripping engagement.
Figure 11:
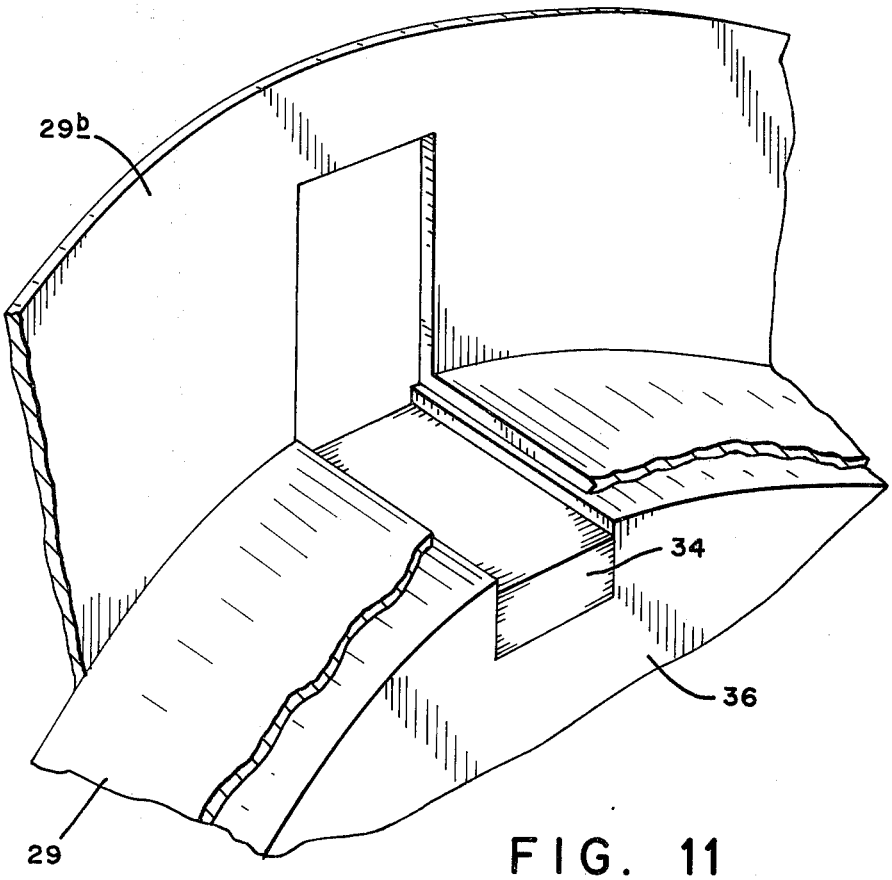
FIG. 11 is a fractional perspective view, in partial cross-section, of the embodiment of the reel and reel core shown in FIG. 10, but omitting the gripping lever and the strip.

With reference to FIGS. 7 through 9, it has further been found that if the filament to be wound employing the gripping and retaining mechanism of the present invention is a metal strip obtained by depositing a stream of molten metal against a rotating chill roll as illustrated in FIG. 1, then the apparatus can be substantially simplified as illustrated in FIGS. 7 through 9. In that event, the gripping lever 27 need not be provided with gripping or cutting edges. Rather that portion of it which engages the strip may be formed in any desired shape such as a round shape, which is not illustrated, or in a shape of a flat bar, as illustrated in FIG. 7. Furthermore, the core of reel 29 need not be provided with the optional recess 29*a*, thereby eliminating optional stationary cutting blade 31 and gripper pad 34, as is illustrated in FIG. 8. In operation, the gripping lever 27 engages the metal strip 12 thereby holding the strip 12 against the core of storage reel 29 in gripping engagement. It has been found that the simplified apparatus as illustrated in FIGS. 7 through 9, when operated in the manner above-described in connection with discussion of FIGS. 1 through 6, serves to grip and hold strip 12 against the core of storage reel 29. Indeed, it has been found that the simplified embodiments shown in FIGS. 7 through 9 and especially those shown in FIGS. 10 and 11, are better suited for gripping and retaining a metal strip advancing at very high speed, say at speeds exceeding about 4000 ft./min., than the above-discussed embodiments illustrated in FIGS. 1 through 6. With reference to FIGS. 10 and 11 there is shown a fragmentary view, in partial cross-section, of a preferred embodiment of apparatus of the present invention suitable for winding metal strip at high speed. In that embodiment, the core of the reel is slipped over hub 36 which is mounted on and forms part of the rotable reel mounting assembly 40, and which may be permanently mounted to the rotable reel mounting assembly. Hub 36 is provided with a recess wherein there is mounted a gripper pad 34. Gripping lever 27 is of the configuration shown in FIG. 7. Face plate **29*b* and core of storage reel 29 are provided with suitable cut-outs to permit operation of the gripping lever in the manner described supra. Gripper pad 34 may be formed of resilient material such as resilient plastic or rubber. The gripping lever 27 is dimensioned such that in closed position its top surface is about even, or perhaps somewhat lower, than the top surface of the core of storage reel 29, thereby permitting ready removal of the filled storage reel and withdrawal of gripping lever 27**.

It will be understood that various modifications of the invention herein disclosed may be made without departing from the spirit and scope of the invention as defined by the claims appended hereto.

We claim:

1. Apparatus for gripping and retaining an advancing filament on a rotating storage reel comprising, in combination:

(a) a reel having a core;

(b) a rotable reel mounting assembly for receiving said reel;

(c) a pivotable filament gripping element associated with said reel mounting assembly having a gripping leg adapted to hold the filament, when the gripping element is in a closed position, against the core of said reel in gripping engagement, and adapted further to be locked in an open position with the leg away from said reel core;

(d) biasing means adapted to pivot said filament gripping element into closed position to bring the gripping leg into gripping engagement with the filament and the core of said reel;

(e) retaining means adapted to releasably hold said gripping element in open position; and (f) triggering means adapted to release said retaining means to permit said biasing means to pivot said filament gripping element into closed position to bring the gripping leg into gripping engagement with the filament and the core of said reel.

2. Apparatus according to claim 1 wherein such triggering means comprises a solenoid.

3. Apparatus according to claim 1 wherein the core of said reel is provided with a recess adapted to receive the gripping leg of said pivotable filament gripping element.

4. Apparatus according to claim 3 wherein a cutting edge is housed in the recess provided in the core of such reel, and wherein the gripping leg of said pivotable filament gripping element is provided with a thin edge which, in conjunction with the cutting edge housed in the recess, functions to sever the filament.

5. Apparatus according to claim 1 wherein said biasing means adapted to pivot said filament gripping element into closed position is a spring means.

6. Apparatus according to claim 4 wherein said triggering means comprises a solenoid, and wherein said biasing means adopted to pivot said filament gripping element into closed position is a spring means.

* * * * *